US009822619B2

(12) United States Patent
Holderman

(10) Patent No.: US 9,822,619 B2
(45) Date of Patent: Nov. 21, 2017

(54) WELL FLOW CONTROL WITH ACID ACTUATOR

(71) Applicant: Halliburton Energy Services, Inc., Houston, TX (US)

(72) Inventor: Luke William Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 230 days.

(21) Appl. No.: 14/654,345

(22) PCT Filed: Dec. 21, 2012

(86) PCT No.: PCT/US2012/071313
§ 371 (c)(1),
(2) Date: Jun. 19, 2015

(87) PCT Pub. No.: WO2014/098903
PCT Pub. Date: Jun. 26, 2014

(65) Prior Publication Data

US 2015/0330191 A1 Nov. 19, 2015

(51) Int. Cl.
*E21B 43/08* (2006.01)
*E21B 43/12* (2006.01)

(52) U.S. Cl.
CPC ..... *E21B 43/12* (2013.01); *E21B 43/08* (2013.01)

(58) Field of Classification Search
CPC ..... E21B 43/12; E21B 43/08; E21B 43/10; E21B 34/063
USPC ..... 166/376
See application file for complete search history.

(56) References Cited

U.S. PATENT DOCUMENTS

| | | | | |
|---|---|---|---|---|
| 3,010,515 | A * | 11/1961 | Harrison | E21B 29/02 166/54.5 |
| 5,558,153 | A | 9/1996 | Holcombe | |
| 5,607,017 | A * | 3/1997 | Owens | E21B 33/12 166/288 |
| 7,832,473 | B2 | 11/2010 | Pensgaard | |
| 7,909,088 | B2 | 3/2011 | O'Malley | |
| 2007/0039741 | A1 | 2/2007 | Hailey, Jr. | |
| 2007/0074873 | A1 | 4/2007 | McKeachnie et al. | |
| 2008/0135249 | A1 | 6/2008 | Fripp et al. | |
| 2009/0151925 | A1* | 6/2009 | Richards | E21B 34/06 166/53 |
| 2011/0094754 | A1* | 4/2011 | Smart | E21B 27/02 166/381 |

(Continued)

OTHER PUBLICATIONS

Patent Examination Report No. 1, Australian Application No. 2012397246, Dec. 15, 2015, 4 pages.

(Continued)

*Primary Examiner* — David Bagnell
*Assistant Examiner* — Yanick Akaragwe
(74) *Attorney, Agent, or Firm* — Scott Richardson; Parker Justiss, P.C.

(57) ABSTRACT

A well production device includes a production tubing with a fluid passage between the exterior of the tubing and a center bore of the tubing. A fluid barrier is provided sealing the fluid passage. The device has a chamber comprising a dissolving fluid adapted to dissolve the fluid barrier when in contact with the fluid barrier and an actuator configured to release the dissolving fluid into contact with the fluid barrier in response to a signal.

14 Claims, 2 Drawing Sheets

(56) References Cited

U.S. PATENT DOCUMENTS

| | | | | |
|---|---|---|---|---|
| 2011/0155372 | A1* | 6/2011 | Panga | C09K 8/80 166/278 |
| 2011/0303420 | A1 | 12/2011 | Thorkildsen et al. | |

OTHER PUBLICATIONS

Canadian Office Action issued in Canadian Application No. 2,891,912 by the Canadian Intellectual Property Office dated Mar. 30, 2016, 3 pages.

PCT International Search Report and Written Opinion of the International Searching Authority, PCT/2012/071313, dated Aug. 27, 2013, 13 pages.

PCT International Preliminary Report on Patentability, PCT/US2012/071313, dated Jul. 2, 2015, 9 pages.

* cited by examiner

WELL FLOW CONTROL WITH ACID ACTUATOR

CLAIM OF PRIORITY

This application is a U.S. National Phase application and claims the benefit of priority to International Application No. PCT/US2012/071313, filed on Dec. 21, 2012, the entire contents of which are hereby incorporated by reference.

BACKGROUND

In completing a well, drilling fluids, such as drilling mud and other fluids in the well during drilling, are circulated out of the well and replaced with a completion fluid. For example, the completion fluid is pumped down the bore of a production string to displace the drilling fluids up the annulus between the production string and wellbore wall, or vice versa. The completion fluids can take different forms, but are typically a solids-free liquid meant to maintain control over the well should downhole hardware fail, without damaging the subterranean formation or completion components. The fluid is typically selected to be chemically compatible with the formation, for example, having a specified pH.

DESCRIPTION OF DRAWINGS

Like reference symbols in the various drawings indicate like elements.

DETAILED DESCRIPTION

Figure 1:
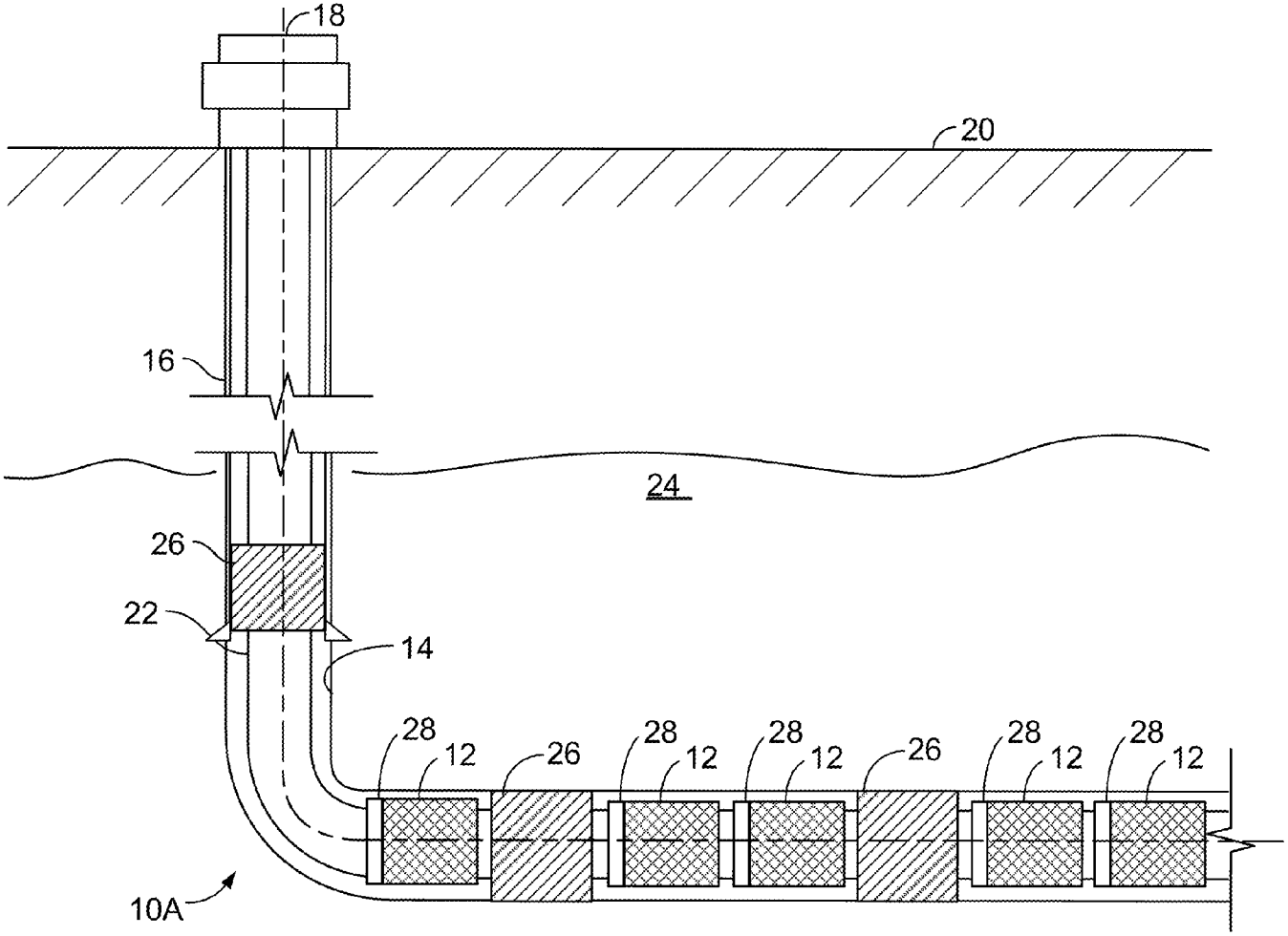
FIG. 1 is side partial cross-sectional views of an example well system.

FIG. 1 shows an example well system 10 in an open hole completion configuration. The well system 10 is shown as a horizontal well, having a wellbore 14 that deviates to horizontal or substantially horizontal in a subterranean zone of interest 24. A type of production tubing, referred to as casing 16, is cemented in the wellbore 14 and coupled to a wellhead 18 at the surface 20. The casing 16 extends only through the vertical portion of the wellbore 14. The remainder of the wellbore 14 is completed open hole (i.e., without casing). A production tubing string 22 extends from wellhead 18, through the wellbore 14 and into the subterranean zone of interest 24. The production string 22 can take many forms, for example, as a continuous tubing string between the subterranean zone 24 and the wellhead 18, as a length of production liner coupled to the casing 16 at a liner hanger with a tieback liner extending from the liner hanger to the wellhead 18, and/or another configuration. A production packer 26 seals the annulus between the production string 22 and the casing 16. Additional packers 26 can be provided between the screen assemblies 12 to seal the annulus between the wellbore wall and the production string 22 and define intervals between the packers 26. The production string 22 operates in producing fluids (e.g., oil, gas, and/or other fluids) from the subterranean zone 24 to the surface 20. The production string 22 includes one or more well screen assemblies 12 (five shown). In some instances, the annulus between the production string 22 and the open hole portion of the wellbore 14 may be packed with gravel and/or sand. The well screen assemblies 12 and gravel/sand packing allow communication of fluids between the subterranean zone 24 and the interior of the production string 22. The gravel/sand packing provides a first stage of filtration against passage of particulate and larger fragments of the formation to the production string 22. The well screen assemblies 12 provide a second stage of filtration, and are configured to filter against passage of particulate of a specified size and larger into the interior center bore production string 22. One or more of the well screen assemblies 12 is provided with a flow control device 28 that controls flow through the well screen assembly 12, between the bore of the production string 22 and the subterranean zone 24. The flow control devices 28 can be configured to be initially closed to seal against communication of fluids between the interior and exterior of the well screen assemblies 12 (and thus, production string 22), and thereafter opened, in response to a hydraulic signal, to allow communication of fluids. In certain instances, the hydraulic signal can be a specified pressure supplied through the interior of the well screen assembly 12. All flow control devices 28 in the production string 22 can be configured to open in response to the same hydraulic signal, or one or more can be configured to open in response to one or more different hydraulic signals (e.g., one or more different pressures).

In other instances, the well system 10 can be a cased completion configuration where the casing and/or a production liner extends through the subterranean zone 24, and in certain instances, throughout the length of the wellbore 14. The casing 16 is provided with openings to allow communication of fluid between the subterranean zone 24 and the interior of the casing 16, and those openings can be provided with flow control devices 28. Also, although shown as a horizontal wellbore, the well system could take other forms, such as a substantially vertical wellbore, a slanted wellbore, a multi-lateral, and/or another configuration.

Prior to completing the well system 10, it is subjected to a fluid exchange operation where drilling fluids, such as drilling mud and other fluids in the well during drilling, are circulated out of the well and replaced with a completion fluid. For example, the completion fluid is pumped down the bore of a production string to displace the drilling fluids up the annulus between the production string and wellbore wall, or vice versa. During the fluid exchange operation, the flow control devices 28 are set to a closed state, sealing against passage of fluid between the interior and exterior of the production string 22. Sealing the flow control devices 28 makes the production string 22 respond to the circulation operation effectively as a continuous (unapertured) tubing. If the flow control devices 28 were not sealed (i.e., open), the ability of the flow control devices 28 to pass fluids could cause a short circuit of the circulation flow and make it more difficult to effectively circulate the fluids from drilling out of the wellbore. When the fluid exchange is complete, one or more of the flow control devices 28 is then set to an open state as the well system 10 is put onto production.

Also, in certain instances, fewer than all of the intervals will be initially produced from. Thus, the flow control devices 28 in these intervals will be left closed until it is desired to produce from these intervals.

Figure 2:
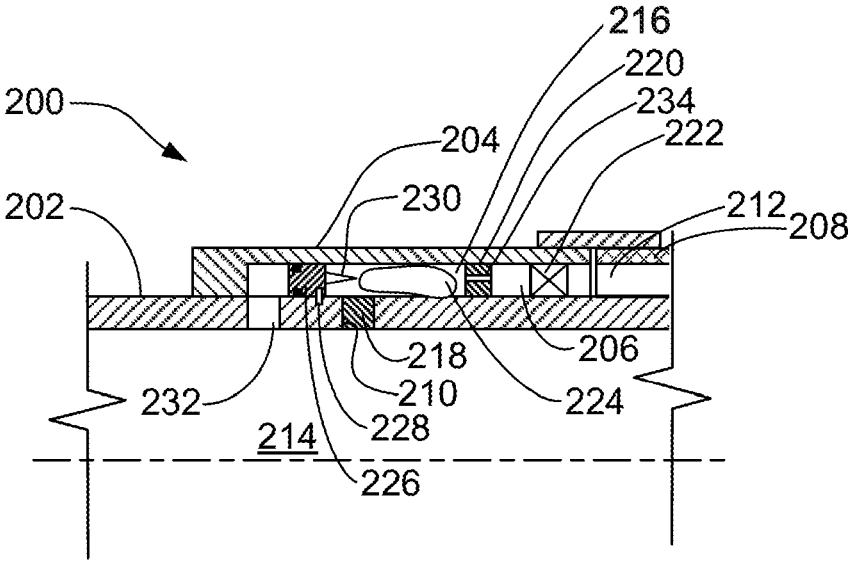
FIG. 2 is a detail half cross-sectional view of a production device.

FIG. 2 shows a schematic configuration of an example flow control device 200 that can be used as flow control device 28. The flow control device 28 is shown in the context of a well screen assembly, but could be used in another a production device or tubing including a casing, a liner, a production string and/or another tubing. The well screen assembly includes a base tubing 202 with a filtration screen 208 positioned circumferentially about the tubing 202. The filtration screen 208 is sealed at one end to the base tubing 202 and sealed to the flow control device 200 at its other end. Therefore, flow between the subterranean zone via the filtration screen 208 and the internal center bore 214 of the base tubing 202, and thus production string, must flow through the flow control device 200. In certain instances, one or more other flow control devices 200 can be positioned on the base tubing 202, for example, at the opposing end of the screen 208 and/or intermediate the ends of the screen 208.

The screen 208 is a filter that filters against passage of particulate of a specified size or larger. Screen 208 can take a number of different forms and can have one or multiple layers. Some example layers include a preformed woven and/or nonwoven mesh, wire wrapped screen (e.g., a continuous helically wrapped wire), apertured tubing, and/or other types of layers. Screen 208 defines an axial fluid passage 212 interior to the screen 208 and/or between the screen 208 and the base tubing 202. The axial fluid passage 212 communicates fluid axially along the length of the well screen assembly.

The flow control device 200 includes an annular housing 204 mounted on the tubing 202. The housing 204 defines an interior fluid passage 206 that communicates between the internal center bore 214 of the tubing 202, via one or more sidewall apertures 210 in the tubing 202, and the axial fluid passage 212 of the filtration screen 208. The flow control device 200 includes a flow restriction 222 in the fluid passage 206 that can produce a specified fixed or variable flow restriction to flow. The flow restriction 222 can be a partial restriction or can selectively seal the fluid passage. The flow restriction 222 can take a number of forms, including fixed or variable orifices, manually operated valves (e.g., operated with a tubing conveyed and/or wire conveyed operating tool downhole or set at the surface by an operator), valves responsive to a surface or downhole signal (e.g., electric, hydraulic, acoustic, optical and/or other signal types), fluid responsive valves (e.g., responsive to fluid pressure, flow rate, viscosity, temperature and/or other fluid characteristics) including fluid diodes, and/or other types of flow restrictions. In certain instances, the flow control device 200 can be a type of device referred to in the art as an inflow control device, and the flow restriction 222 can be the primary working components of such a device. A number of different inflow control device configurations can be used.

The annular housing 204 defines a dissolving fluid chamber 216 intermediate the fluid passage 206. The chamber 216 surrounds sidewall aperture 210, and plugs 218 are provided in and sealing the apertures 210. The chamber 216 is also open to the fluid passage 212 of the screen 208 and another plug 220 is provided in and sealing the opening to the fluid passage 212. The plugs 218, 220 operate as fluid barriers that seal against passage of fluid through the fluid passage 206, and between an interior of the screen 208 and center bore 214.

The dissolving fluid chamber 216 contains a dissolving fluid adapted to dissolve the plugs 218,220 when the fluid is in contact with the plugs. In certain instances, the plugs 218, 220 are aluminum and the dissolving fluid is an acid selected to dissolve the plugs 218, 220. In certain instances, the dissolving fluid is contained in a bladder 224 within the chamber 216. The bladder 224 can be made of or internally coated with a material that does not dissolve (substantially or at all) from the dissolving fluid. The bladder 224 contains the dissolving fluid out of contact with the plugs 218, 220. Alternatively or additionally, the dissolving fluid can be contained in another manner, e.g., between frangible walls in the chamber 216 and/or in another manner. The housing 204, the tubular 202, and any other items that contact the dissolving fluid can be made of or coated with a material that does not dissolve (substantially or at all) from the dissolving fluid.

Initially, when the fluid control device 200 is run into the well, the dissolving fluid is maintained out of contact with the plugs 218, 220 and the fluid passage 206 sealed. Thereafter, an actuator responds to a remote signal from a surface or downhole source to release the dissolving fluid into contact with the plugs 218, 220, dissolve the plugs, and open the fluid passage 206 to communicate fluid. The actuator and signal can take a number of forms. For example, the actuator can respond to a hydraulic, electric, optical and/or another signal. FIG. 2 shows an example that is responsive to a hydraulic signal. Thus, the actuator of FIG. 2 includes a piston 226 carried to move within the housing 204 in response to hydraulic pressure, but initially fixed relative to the bladder 224. In certain instances, the piston 226 is fixed by a shear fastener 228 (e.g., a shear screw, pin or block), but the piston 226 could be fixed in another manner such as with a detent, a snap ring, a spring and/or another manner. One end of the piston 226 is in fluid communication with the center bore 214 through one or more sidewall openings 232, such that a pressure signal supplied into the center bore 214 acts on the piston 226. When the pressure signal is great enough to unfix the piston 226 (e.g, shear the shear fastener 228), the piston 226 is moved to rupture the bladder 224. In certain instances, the piston 226 can include a sharp tip 230 to facilitate rupturing the bladder 224. The shear fastener 228 can be configured to fix the piston 226 and only shear when pressure in the center bore 214 is at least a specified actuation pressure. In certain instances, the actuation pressure can be selected to be higher than the pressure experienced during the completion fluid exchange. The chamber 216 can be provided with a weep passage 234 configured to allow any pressure in the chamber 216 to weep out when the piston 226 is moved.

Thus, in operation, the flow control device 200 is provided into the wellbore in an initial closed state, sealing against flow between the center bore 214 and the exterior of the well screen assembly (and the production string). Completion fluid is pumped down the bore 214 to displace the drilling fluids up the annulus between the production tubing and wellbore wall, or vice versa. In the sealed state, the production tubing responds to the circulation operation effectively as continuous (unapertured) tubing, preventing short circuits through the flow control device 200. When it is desired to open the flow control device 200 and allow fluid communication between the center bore 214 and the exterior of the well screen assembly, a signal (e.g., a pressure of at least a specified actuation pressure in the center bore) is provided to the flow control device 200. In certain instances of a flow control device 200 responsive to a hydraulic signal, the production string can be plugged below the flow control device 200 and the pressure signal provided by pressurizing the fluid in the center bore 214 above the plug. Alternatively or additionally, an actuation tool can be run into the interior of the well screen assembly, positioned with seals spanning the opening 232, and the pressure signal supplied. If more than one flow control device 200 is supplied in the production string, they can all be actuated to open in response to the same signal, some open in response to different signals or, if operated using an actuation tool, some can be actuated to open while others are not.

In certain instances, the flow control device provides a simple, low cost manner of providing remotely openable production devices. The simplicity stems from the few number of moving parts associated with the dissolving liquid used to dissolve the plugs. Also, the arrangement can be compactly incorporated into existing inflow control devices to enable the devices to be closed until it is desired to open them.

A number of embodiments have been described. Nevertheless, it will be understood that various modifications may be made. Accordingly, other embodiments are within the scope of the following claims.

What is claimed is:

1. A well screen assembly, comprising:

a tubular base tubing;

an annular housing around the base tubing;

a filtration screen around the base tubing;

a plug sealing a flow path between an interior of the filtration screen and an interior center bore of the base tubing; and a dissolving fluid chamber defined by the annular housing and comprising a fluid chamber having a bladder containing a dissolving fluid adapted to dissolve the plug when in contact with the plug, wherein the plug seals an opening from the dissolving fluid chamber to the center bore of the base tubing, and further comprising a second plug being located in an opening from the dissolving fluid chamber to the interior of the filtration screen; and an actuator located within the annular housing and comprising a piston movable to rupture the bladder in response to pressure from the center bore of the base tubing to release the dissolving fluid into contact with the plug and the second plug to open the flow path to communicate fluid between the interior of the filtration screen and the interior of the base tubing.

2. The well screen assembly of claim 1, where the actuator is responsive to a hydraulic signal provided through the interior of the base tubing.

3. The well screen assembly of claim 1, comprising a shear fastener fixing the piston against movement until the shear fastener is sheared, the shear fastener sized to shear when pressure in the center bore of the base tubing is at least a specified actuation pressure.

4. The well screen assembly of claim 1, comprising a weep passage configured to allow pressure to weep from the dissolving fluid chamber when the piston is moved.

5. The well screen assembly of claim 1, comprising an inflow control device and where the inflow control device comprises the plug sealing a flow path through the inflow control device.

6. The well screen assembly of claim 1, comprising a flow restriction in the flow path adapted to produce a specified flow restriction to flow through the flow path.

7. The well screen assembly of claim 1, where the plug comprises aluminum and the dissolving fluid comprises acid.

8. A well production device, comprising:

a production tubing comprising a fluid passage between the exterior of the tubing and a center bore of the tubing;

a fluid barrier sealing the fluid passage;

a chamber comprising a dissolving fluid adapted to dissolve the fluid barrier when in contact with the fluid barrier; and an actuator configured to release the dissolving fluid into contact with the fluid barrier, and comprising a bladder in the chamber containing the dissolving fluid and a piston responsive to pressure to rupture the bladder and release the dissolving fluid into contact with the fluid barrier.

9. The well production device of claim 8, where the production tubing comprises a filtration screen around a tubular base tubing.

10. The well production device of claim 8, where the actuator is responsive to release the dissolving fluid when pressure in the center bore of the production tubing is at least a specified actuation pressure.

11. The well production device of claim 8, where the fluid passage extends through the chamber and the fluid barrier seals an opening to the chamber; and comprising a second fluid barrier in a second opening to the chamber.

12. The well production device of claim 8, where the fluid barrier comprises an aluminum plug and the dissolving fluid comprises an acid adapted to dissolve the aluminum plug.

13. A method of controlling flow in a well, the method comprising:

receiving, in a flow control device, flow in a path between an interior center bore of a tubular base tubing and a filtration screen about the base tubing;

in response to a signal, rupturing a bladder located within the flow control device with a piston located with the flow control device and releasing a dissolving fluid contained in the bladder into contact with a plug that seals the path against fluid communication with the center bore dissolve the plug to allow flow through the path from the control device and into the interior center bore of the tubular base tubing.

14. The method of claim 13, further comprising, after dissolving the plug, restricting flow through the path to a specified flow.

* * * * *